United States Patent [19]

Tada

[11] Patent Number: 4,504,212

[45] Date of Patent: Mar. 12, 1985

[54] CONTROL APPARATUS FOR DENTAL GAS BURNER

[75] Inventor: Yoshikazu Tada, Tokyo, Japan

[73] Assignee: Hayashikane Shipbuilding & Engineering Co. Ltd., Yamaguchi, Japan

[21] Appl. No.: 562,140

[22] Filed: Dec. 16, 1983

[30] Foreign Application Priority Data

Jul. 26, 1983 [JP] Japan ..... 58-115147[U]

[51] Int. Cl.[3] ..... F23N 5/00

[52] U.S. Cl. ..... 431/86; 431/18

[58] Field of Search ..... 431/18, 73, 86, 87

[56] References Cited

U.S. PATENT DOCUMENTS 3,372,306 3/1968 Koizumi ..... 431/18

*Primary Examiner*—Carroll B. Dority, Jr.

*Attorney, Agent, or Firm*—Blum Kaplan Friedman Silberman & Beran

[57] ABSTRACT

A control apparatus for a dental gas burner is disclosed which is capable of variably setting combustion time of the burner as desired. The control apparatus comprises a circuit for operating a solenoid valve provided at a fuel gas supply pipe, a circuit for igniting fuel gas ejected from a burner nozzle, a command circuit including a touch sensor and generating a pulse every touch with respect to the touch sensor, a combustion time setting circuit acting to count pulses of the command circuit to set combustion time corresponding to the number of counted pulses to open the valve during the time, and a timing circuit for supplying to the combustion time setting circuit a count signal required for counting the pulses.

8 Claims, 3 Drawing Figures

CONTROL APPARATUS FOR DENTAL GAS BURNER

BACKGROUND OF THE INVENTION

1. Field of the Invention

This invention relates to a control apparatus for a dental gas burner, and more particularly to a control apparatus which is adapted to determine combustion time of a dental gas burner as desired depending upon the number of contacts or touches with respect to the apparatus by an operator.

2. Description of the Prior Art

A dental gas burner is generally used for heating a dental article such as a dental equipment, dental chemicals, a dental material or the like. The dental gas burner causes the pollution of air in a consultation room and the waste of fuel gas when it is left ignited. Whereas, when the dental gas burner is unexpectedly extinguished, fuel gas is discharged to cause danger. Thus, it is desired that the dental gas burner is ignited every use and extinguished immediately after the use. However, such operation of the burner puts an operator such as a dentist to much trouble, thus, the burner is typically kept at a combustion or ignition state irrespective of the above-mentioned disadvantages.

In order to eliminate the foregoing disadvantage, a control unit using a photoelectric detector arranged in proximity to a gas injection nozzle of a dental gas burner has been proposed in Japanese Utility Model Application Laid-Open Publication No. 51092/1983 wich is adapted to allow the burner to automatically start combustion when the detector detects the approach of an article to be heated such as a dental equipment to the nozzle and permit the burner to be automatically extinguished when the article is away from the nozzle. The photoelectric detector comprises a light emitting element and a light receiving element. However, the conventional control unit is constructed in a manner such that the burner may carry out combustion only for a period of time during which an article is interposed between the light emitting element and the light receiving element to interrupt an optical path therebetween. Thus, the control unit has a disadvantage of readily causing malfunction because it causes the burner to be ignited when an unexpected article is interposed between the light emitting element and the light receiving element or it causes the burner to be extinguished when light other than that generated from the light emitting element is incident upon the light receiving element.

Also, another control unit has been proposed which utilizes a switch means. Such conventional control unit is constructed in such a manner that the burner is ignited to carry out combustion for a predetermined period of time when an operator touches the switch means directly or indirectly through a conductive article and then the switch means automatically closes a gas valve to extinguish the burner. The control unit is superior in decreasing malfunction to the aforesaid control unit. However, it has a disadvantage that it causes the workability to be significantly reduced or increases waste combustion of the burner because heating time required is not coincident with combustion time of the burner due to its constant combustion time.

BRIEF SUMMARY OF THE INVENTION

The present invention has been made in view of the foregoing disadvantages of the prior art.

Accordingly, it is an object of the present invention to provide a control apparatus for a dental gas burner which is capable of automatically igniting a burner only by touching a touch sensor and variably setting combustion time of the burner as desired depending upon the number of touches with respect to the sensor.

It is another object of the present invention to provide a control apparatus for a dental gas burner which is capable of setting combustion time of a burner by varying the number of touches depending upon a dental operation.

It is another object of the present invention to provide a control apparatus for a dental gas burner which is capable of substantially preventing malfunction.

It is a further object of the present invention to provide a control apparatus for a dental gas burner which is capable of automatically carrying out the combustion of a burner only for a period of time required for a heating operation, to thereby prevent the pollution of air in a consultation room and accomplish the fire-extinguishing without putting an operator to any trouble.

It is still a further object of the present invention to provide a control apparatus for a dental gas burner which is capable of accomplishing the above-mentioned objects with a simple construction.

In accordance with the present invention, there is provided a control apparatus for a dental gas burner comprising a valve operating circuit for operating a solenoid valve provided at a fuel gas supply pipe connected to a nozzle of said gas burner; an ignition circuit for igniting fuel gas ejected from said burner nozzle; a command circuit including a touch sensor, said command circuit being adapted to generate a pulse every time when an operator touches said touch sensor; a combustion time setting circuit which is adapted to count said pulses generated from said command circuit to set combustion time corresponding to the number of counted pulses and supply a signal for opening said solenoid valve to said valve operating circuit; and a timing circuit for supplying to said combustion time setting circuit a count signal required for counting the number of pulses after said solenoid valve is opened.

In a preferred embodiment, the touch sensor comprises a metal ring electrode which is adapted to detect the variation of a predetermined level or more in electrostatic capacity between said metal ring electrode and the earch.

BRIEF DESCRIPTION OF THE DRAWINGS

Other objects and many of the attendant advantages of the present invention will be readily appreciated as the same becomes better understood by reference to the following detailed description when considered in connection with the accompanying drawings, in which like reference numerals and characters designate the same parts throughout the figures thereof and wherein.

DETAILED DESCRIPTION OF THE PREFERRED EMBODIMENT

Now, a control apparatus for a dental gas burner according to the present invention will be described hereinafter with reference to the accompanying drawings.

Figure 1:
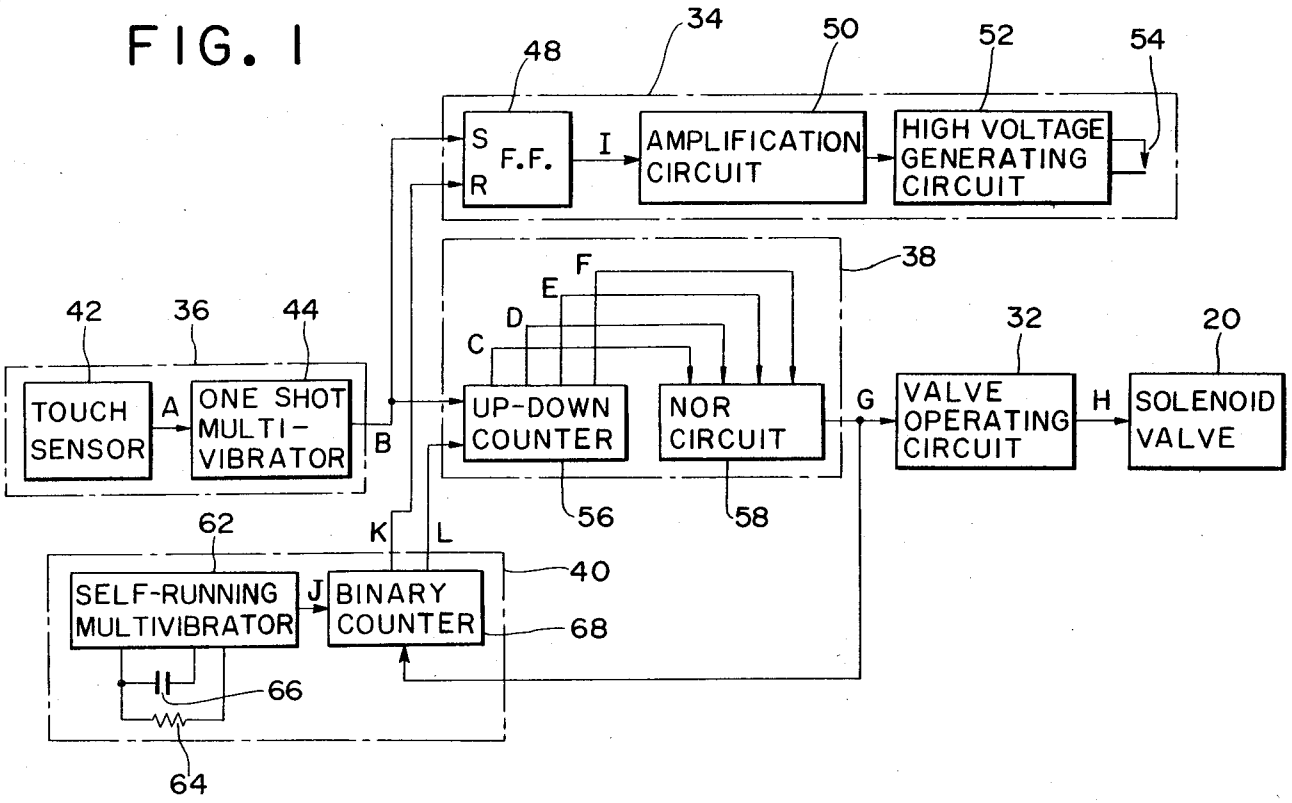
FIG. 1 is a block diagram showing an embodiment of a control apparatus for a dental gas burner according to the present invention.
Figure 2:
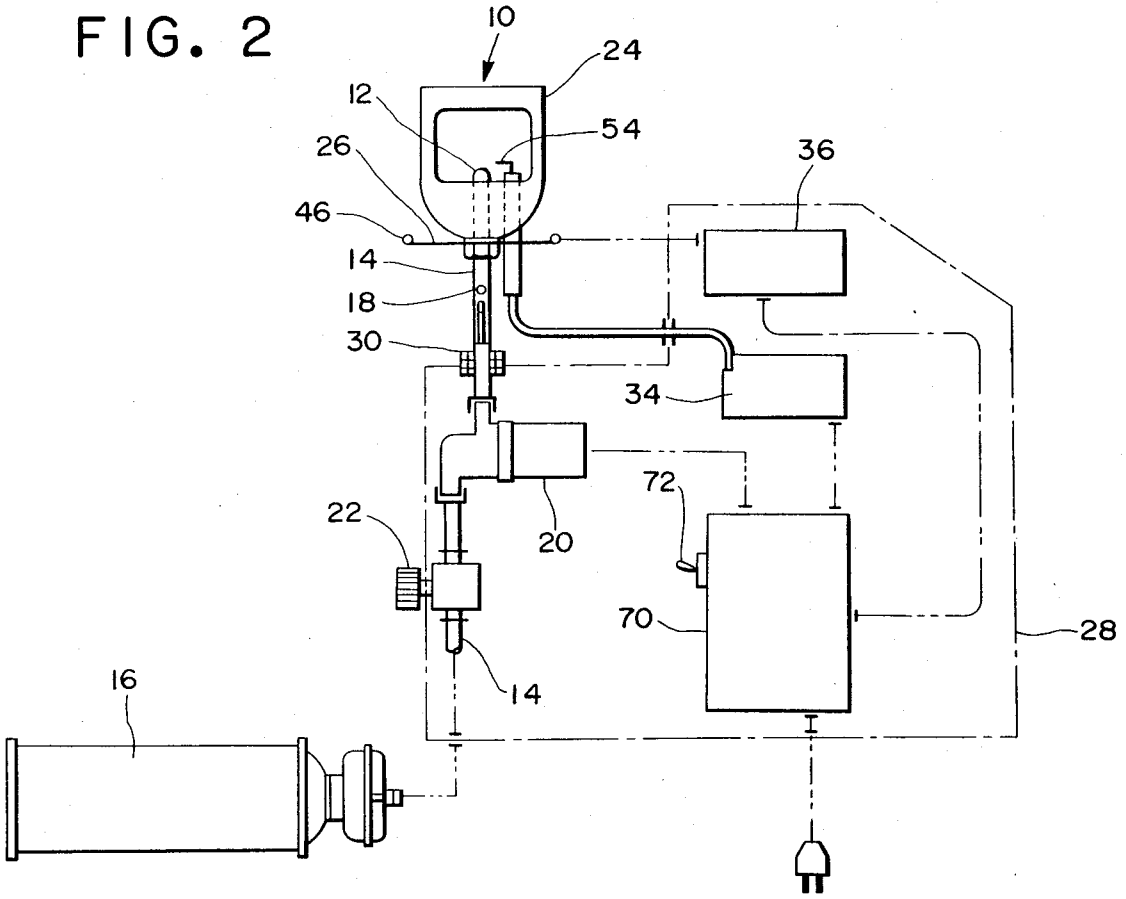
FIG. 2 is a schematic view showing an example of a dental gas burner which is adapted to be equipped with a control apparatus according to the present invention.

A control apparatus for a dental gas burner of the present invention illustrated in FIG. 1 is adapted to be incorporated in a dental gas burner as shown in FIG. 2. The dental gas burner generally designated by reference numeral 10 in FIG. 2 includes a burner nozzle 12 and a gas supply pipe 14. The gas supply pipe 14 is connected at one end thereof to the burner nozzle 12 and at the other end thereof to a fuel gas supply source 16 such as a fuel gas bomb. The gas supply pipe 14 has an air intake 18, a solenoid valve 20 and a main cock 22 provided thereon in turn. The gas burner 10 also includes a hood 24 for surrounding the nozzle 12 and a tray 26 provided at the lower end of the hood 24. The gas burner constructed in the manner as described above is mounted with respect to a frame 28 through a seat 30.

A control apparatus of the present invention which is adapted to be used for such a dental gas burner as illustrated in FIG. 2, as shown in FIG. 1, includes a valve operating circuit 32 for operating the solenoid valve 20 and an ignition circuit 34 for igniting fuel gas ejected from the burner nozzle 12. The control apparatus further comprises a command circuit 36 for supplying a command of an operator to the valve operating circuit 32 and the ignition circuit 34, a combustion timing setting circuit 38 for setting combustion time of the burner based on the command described above, and a timing circuit 40 for supplying a count signal to the combustion time setting circuit 38 and supplying an ignition terminating signal to the ignition circuit 34.

In the embodiment, the command circuit 36 comprises a touch sensor 42 actuated when an operator such as a dentist touches it, and a one shot multivibrator 44 started by the output of the sensor 42 to generate an output thereof. The touch sensor 42 is constructed to generate an electrical signal when the operator touches or lightly presses a fixed portion thereof. A sensor which is adapted to detect the variation in electrostatic capacity of an electrode occurring due to touching may be used as the touch sensor 42. Alternatively, the sensor 42 may be formed using a microswitch, a semiconductor pressure sensitive switch or the like. The embodiment illustrated uses the former sensor as the touch sensor 42. More particularly, the touch sensor 42 includes a metal ring 46 acting as an electrode which is arranged around the tray 26 formed of an insulating material, and detects the variation in electrostatic capacity between the metal ring 46 and the earth caused when the operator touches the ring. The sensor 42 is adapted to generate a detection signal when detecting the capacity variation of a predetermined level or more.

The ignition circuit 34 comprises a flip-flop circuit 48 set by or depending upon a pulse generated from the one shot multivibrator 44 on the basis of the detection signal of the touch sensor 42, an amplification circuit 50 for amplifying the output of the flip-flop circuit 48, a high voltage generating circuit 52 for forming a high voltage utilizing the output of the flip-flop circuit 48 amplified by the amplification circuit 50, and a discharge electrode 54 arranged in proximity to the burner nozzle 12 to accomplish spark discharge utilizing the high voltage generated by the high voltage generating circuit 52. The flip-flop circuit 48 keeps the burner 10 at an ignition state until it is reset by an ignition terminating signal supplied from the timing circuit 40 hereinafter described in detail.

The combustion time setting circuit 38 comprises an up-down counter 56 and a NOR circuit 58. The up-down counter 56 is connected at the count-up terminal thereof with the output of the one shot multivibrator 44 and at the count-down terminal thereof with the output of the timing circuit 40, and is adapted to supply the outputs C, D, E and F to the NOR circuit. A level of the NOR circuit is kept low except the case that the up-down counter 56 indicates the counting of "0".

The valve operating circuit 32 connected with the output of the NOR circuit 58 comprises an inversion amplifier and is adapted to flow a driving circuit which allows the solenoid valve 20 to be opened when the output of the NOR circuit 58 is at a low level and allows the valve 20 to be closed when the NOR circuit generates an output of a high level. Such driving current is flowed only at the time of opening the solenoid valve 20, when a normal-close type solenoid valve is used as the valve 20.

The timing circuit 40 in the illustrated embodiment comprises a self-operating or self-running multivibrator 62 oscillating at a frequency determined by a resistor 64 and a capacitor 66, and a binary counter 68 which acts to divide the output of the self-running multivibrator 62 to generate an ignition terminating signal supplied to the ignition circuit 34 and a count signal supplied to the combustion time setting circuit 38.

In the present embodiment, the combustion time setting circuit 38, valve operating circuit 32 and timing circuit 40 are arranged on a single printed board 70 (FIG. 2), and the command circuit 36 and ignition circuit 34 are provided separate from the printed board 70. However, the present invention is not limited to such arrangement. Reference numeral 72 indicates a power switch mounted on the printed board 70, which acts to operate a power circuit (not shown). Such power circuit supplies a power to the command circuit 36 and ignition circuit 34 as well as the circuits 32, 38 and 40 provided on the printed board 70.

Now, the manner of operation of the control apparatus of the present embodiment constructed in the manner as described above will be explained with reference to FIGS. 1 to 3.

Figure 3:
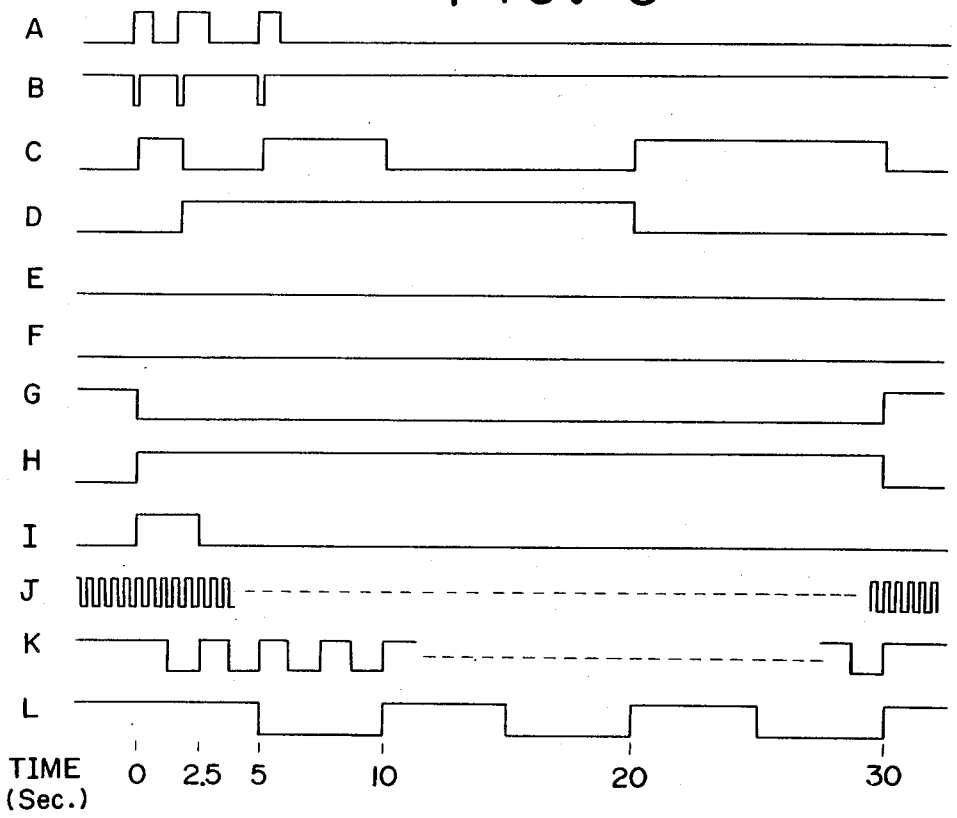
FIG. 3 is a wave form chart showing a wave form obtained at each of the portions indicated by alphabets in FIG. 1.

FIG. 3 is a wave form chart showing a wave form obtained at each of the portions indicated by alphabets in FIG. 1.

The operation of heating a dental article is initiated when an operator such as a dentist touches the metal ring or electrode 46 forming the touch sensor 42 directly or indirectly through an article to be heated, a pincette with which the article is picked up, or the like to allow the burner to be ignited. In this instance, the number of touches are determined depending upon combustion time required. The present embodiment is on the assumption that the number of touches is three.

One of features of the present invention is in that the electrostatic capacity between the metal ring 46 and the earth is varied every time when the operator touches the metal ring 46 directly or indirectly. Such variation of a predetermined level or more in electrostatic capacity is electrically detected by the touch sensor 42, which generates a pulse-like detection signal A shown in FIG. 3 on the basis of such variation. The detection signal A acts as a trigger for the one shot multivibrator 44 to allow the vibrator 44 to generate negative pulses B corresponding to the number of touches. Three pulses B are generated in this embodiment.

The negative pulses B are supplied to the count-up terminal of the up-down counter 56, in which the rising thereof is counted. The first one of the pulses B allows the output terminal C of the counter 56 to be at a high level (FIG. 3C). Then, the supply of the second pulse B to the counter 56 allows the output terminal D to be at a high level and the output terminal C to be at a low level; and the supply of the third pulse B thereto permits the terminal C to be at a high level again. Thus, it will be noted that the up-down counter 56 starts at "0" and counts the three pulses in the order of 0001, 0010 and 0011.

When the first pulse B is counted and the output terminal C of the up-down counter 56 is allowed to be at a high level, the output of the NOR circuit of which all the input has been zero and the output has been kept at a high level is changed to a low level (FIG. 3G). This allows the valve operating circuit 32 to generate a driving current H and supply it to the solenoid valve 20 to open it, to thereby eject fuel gas of the gas supply source 16 from the burner nozzle 12.

The first pulse B mentioned above is supplied also to the flip-flop circuit 48 of the ignition circuit 34 to keep the circuit 48 at a set state, to thereby allow the output of the circuit 48 to be at a high level (FIG. 3I). The output I is amplified by the amplification circuit 50 and then allows the high voltage generating circuit 52 to generate a high voltage, so that the discharge electrode 54 may carry out spark discharge. Such spark discharge permits the fuel gas ejected from the burner nozzle 12 to be ignited to start combustion at the burner 10.

Also, the output G of the NOR circuit 58 is changed to a low level to permit the binary counter 68 of the timing circuit 40 to start. This allows the binary counter 68 to stand ready to carry out the counting operation to divide the oscillation output J supplied from the self-running multivibrator 62. In this embodiment, the binary counter 68 divides the output J and generates two kinds of pulses which respectively have a cycle of 2.5 sec. and that of 10 sec. The pulse of the former cycle is supplied as an ignition terminating signal to the reset terminal of the flip-flop circuit 48, and the pulse of the latter cycle is supplied as a count signal L to the count-down terminal of the up-down counter 56.

The ignition terminating signal K, as shown in FIG. 3K, rises at the time when one cycle has elapsed after the ignition. This allows the flip-flop circuit 48 to be reset and the output I to be reversed to a low level, to thereby terminate the ignition. Thus, in the embodiment, the ignition time is 2.5 sec.

The count signal L, as shown in FIG. 3L, rises at the time when one cycle has elapsed after carrying out the up-count of the first pulse, to thereby carry out the down-count (−1) of the number of counts counted by the up-down counter 56. For this purpose, the output terminal C, as shown in FIG. 3C, is changed to a low level. In this instance, supposing that the number of touches is one or only the output terminal C is at a high level, the down-count of −1 causes the outputs C to F of the up-down counter 56 to be zero. This results in the output of the NOR circuit 58 being at a high level, so that the valve operating circuit 32 stops the generation of the valve opening current H. Thus, in the present embodiment, the combustion time obtained by one touch is 10 sec.

In the embodiment, three pulses are counted. Thus, even when the output terminal C of the up-down counter 56 is at a low level as described above, the output terminal D is still at a high level. This allows the output of the NOR circuit to be kept at a low level, resulting in the combustion being continued.

When further 10 sec. elapse and the number of counts of the up-down counter 56 is subjected to the down-count of −1, the output terminal D is reversed to a low level and the output terminal C is changed to a high level. Subsequently, the lapse of further 10 sec. causes the up-down counter 56 to be subjected to the further down-count of −1, so that the output terminal C is changed to a low level. This results in all of the terminals C to F being zero, so that the output of the NOR circuit becomes to a high level to stop the valve driving current H as shown in FIG. 3. Thus, the solenoid valve 20 is closed to terminate the combustion.

When it is desired to further continue the combustion, this may be carried out by touching the metal ring 46 at the number of times corresponding to combustion time required, before the combustion is terminated. In the embodiment, combustion time is set at 10 sec. every touch, thus, the number of touches necessary for combustion time required is readily found by an equation, n (the number of touches)$\times 10 = t_x$ (combustion time). Further, the continuous combustion for a long period of time may be carried out by connecting an earth wire with the metal ring 46. In this instance, it is not required for an operator to touch the metal ring 46.

As can be seen from the foregoing, the control apparatus of the present invention is constructed in the manner to allow the burner to be automatically ignited only by touching the touch sensor and allow combustion to be continued by touching the sensor at the number of times corresponding to combustion time required. Thus, it will be noted that the present invention can determine any combustion time as desired by varying the number of touches depending upon a dental operation. Also, the present invention can substantially prevent malfunction to significantly improve the reliability of a burner, because the burner is never ignited unless an operator touches the touch sensor and combustion time is set depending upon the number of touches. Furthermore, the present invention can automatically carry out the combustion of a burner only for a period of time required for a heating operation, to thereby prevent the pollution of air in a consultation room and accomplish the fire-extinguishing without putting an operator to any trouble.

It will thus be seen that the objects of the present invention set forth above, among those other objects made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A control apparatus for a dental gas burner, comprising:

a valve operating circuit for operating an solenoid valve provided at a fuel gas supply pipe connected to nozzle of said gas burner;

an ignition circuit for igniting fuel gas ejected from said burner nozzle;

a command circuit including a touch sensor, said command circuit being adapted to generate a pulse every time when an operator touches said touch sensor;

a combustion time setting circuit which is adapted to count said pulses generated from said command circuit to set combustion time corresponding to the number of counted pulses and supply a signal for opening said solenoid valve to said valve operating circuit; and a timing circuit for supplying to said combustion time setting circuit a count signal required for counting the number of pulses after said solenoid valve is opened.

2. A control apparatus for a dental gas burner as defined in claim 1, wherein said command circuit further comprises a one shot multivibrator which is adapted to be started by the output of said touch sensor to generate a pulse.

3. A control apparatus for a dental gas burner as defined in claim 2, wherein said touch sensor comprises a metal ring electrode which is adapted to detect the variation of a predetermined level or more in electrostatic capacity between said metal ring electrode and the earth to generate a detection signal.

4. A control apparatus for a dental gas burner as defined in claim 3, wherein said ignition circuit comprises a flip-flop circuit set by said pulse generated from said one shot multivibrator based on said detection signal generated from said touch sensor, an amplification circuit for amplifying the output of said flip-flop circuit, a high voltage generating circuit for generating a high voltage utilizing said output of said flip-flop circuit amplified by said amplification circuit, and a discharge electrode arranged in proximity to said burner nozzle and adapted to carry out spark discharge utilizing a high voltage generated from said high voltage generating circuit.

5. A control apparatus for a dental gas burner as defined in claim 4, wherein said combustion time setting circuit comprises an up-down counter connected at the count-up terminal thereof with the output of said one shot multivibrator and at the count-down terminal thereof with the output of said timing circuit, and a NOR circuit connected to said up-down counter.

6. A control apparatus for a dental gas burner as defined in claim 5, wherein said valve operating circuit comprises an inversion amplifier connected to the output of said NOR circuit to flow a driving current which allows said solenoid valve to be opened when the output of said NOR circuit is at a low level and to be closed when the output thereof is at a high level.

7. A control apparatus for a dental gas burner as defined in claim 5, wherein said solenoid valve is a normal-close type, and said valve operating circuit comprises an inversion amplifier connected to the output of said NOR circuit to flow a driving current which allows said solenoid valve to be opened when the output of said NOR circuit is at a low level.

8. A control apparatus for a dental gas burner as defined in claim 6, wherein said timing circuit comprises a self-running multivibrator oscillating at a predetermined frequency and a binary counter for dividing the output of said self-running multivibrator to supply an ignition terminating signal to said ignition circuit and a count signal to said combustion time setting circuit.

* * * * *